US006159311A

United States Patent [19]

Amaya et al.

[11] Patent Number: 6,159,311

[45] Date of Patent: Dec. 12, 2000

[54] MARTENSITIC STAINLESS STEEL PIPE AND METHOD FOR MANUFACTURING THE SAME

[75] Inventors: Hisashi Amaya, Kyoto; Masakatsu Ueda, Nara; Kunio Kondo, Hyogo, all of Japan

[73] Assignee: Sumitomo Metal Industries, Ltd., Osaka, Japan

[21] Appl. No.: 09/479,233

[22] Filed: Jan. 7, 2000

Related U.S. Application Data

[63] Continuation-in-part of application No. 09/169,954, Oct. 13, 1998, abandoned.

[51] Int. Cl.[7] ..... C22C 38/38; C22C 38/40; C22C 38/18; C21D 7/00

[52] U.S. Cl. ..... 148/325; 148/333; 148/909; 148/506; 148/592; 148/593

[58] Field of Search ..... 148/325, 333, 148/909, 506, 592, 593

[56] References Cited

U.S. PATENT DOCUMENTS 5,944,921 8/1999 Cumino et al. .

FOREIGN PATENT DOCUMENTS 3-82711 4/1991 Japan .

*Primary Examiner*—Deborah Yee
*Attorney, Agent, or Firm*—Clark & Brody

[57] ABSTRACT

A martensitic stainless steel pipe comprises, on the weight basis, C: 0.005 to 0.2%, Si: 1% or below, Mn: 0.1 to 5%, Cr: 7 to 15%, and Ni: 0 to 8%, wherein a wall thickness t (mm) and contents of C and Cr satisfy the relationship represented by the following equation (1).

$$t(\text{mm}) \leq \exp\{5.21-18.1\text{C}(\%)-0.0407\text{Cr}(\%)\} \quad (1)$$

The steel pipe can be made by employing water quenching as a quenching method.

10 Claims, 1 Drawing Sheet

MARTENSITIC STAINLESS STEEL PIPE AND METHOD FOR MANUFACTURING THE SAME

This application is a continuation-in-part of U.S. Ser. No. 09/169,954, filed Oct. 13, 1998, now abandoned.

BACKGROUND OF THE INVENTION

1. Field of the Invention

This invention relates to a martensitic stainless steel pipe which has good strength and toughness, and is suitable for use as a material for drilling oil wells or natural gas wells, and constructing various plants and buildings.

2. Description of The Relates Art

Martensitic stainless steel represented by a 13% Cr martensitic stainless steel, is generally used in the quench hardening and tempering condition to improve strength and corrosion resistance. Since this type of steel pipe has very good hardenability, it can be well hardened to the center of a pipe wall, depending on the size and chemical composition thereof, even if air cooling from high temperature is applied. In case where quench hardening is carried out by use of a refrigerant, the usual practice is to employ oil cooling which permits a slow cooling rate.

However, a steel having good hardenability tends to suffer quench cracks or deformation by quenching. The hardening of such steel is ascribed to the transformation of the austenite phase at high temperatures into a martensite phase by quenching. This transformation brings about a great volumetric expansion. Accordingly, when the cooling rate is too high, heterrogenous, abrupt deformation takes place, resulting in the local concentration of internal stress, to cause cracks.

In recent years, it becomes necessary to drill oil or natural gas well under severe conditions of a corrosive environment. This, in turn, requires a steel pipe, having high corrosion-resistant and high strength for use as oil well tubular goods or allied facilities. For the manufacture of such pipe, there have been developed direct quench hardening methods wherein a steel pipe under still high temperature condition, just after hot workings such as piercing, and rolling, is hardened as it is. However, in the manufacture of stainless steel pipes, having a martensite structure, cracks can occur due to rapid cooling, such as water cooling, as the direct quench hardening method, thus making it difficult to apply quench hardening in water. Thus, it inevitableiy takes a long time, to sufficiently cool slowly from high temperatures, presenting the problem that the productivity lowers considerably. Moreover, the cooling rate cannot be made great, so that a wide space for keeping steel pipes being cooled over a long time becomes necessary, inviting a rise in facility cost.

For a hardening method of 9% Cr or 13% Cr martensitic stainless steel, there is disclosed, in Japanese Laid-open Patent Application No. 3-82711, a method wherein a steel pipe, having a wall thickness of 10 to 30 mm is acceleratedly cooled at a rate of 1 to 20° C./second by blowing water from a nozzle thereagainst. In water quenching, wherein a heated steel pipe is immersed into a water vessel, the quenching rate is 40° C./second or over, resulting in quench cracks in most cases. If, however, the cooling rate is appropriately controlled, as a disclosed method, little or no quench crack takes place, with the attendant advantage that the cooling efficiently proceeds. However, when the above disclosed method is adopted, a particular cooling apparatus and control means are needed in addition to those for an ordinary carbon steel pipe. In addition, although the above method permits a high cooling rate, the rate is not greater than half of a cooling rate in the water immersing method,so that a remarkable improvement in productivity can not be achieved.

SUMMARY OF THE INVENTION

The object of this invention is to provide a stainless steel pipe, excellent in strength and toughness, which is composed substantially of a single phase having 95% or over of a martensite phase and a method for manufacturing such a steel pipe, without causing any quench crack when water quenching is performed during the manufacturing process.

The martensitic stainless steel pipe of the present invention comprises, on the weight basis, C: 0.005 to 0.2%, Si: 1% or below, Mn: 0.1 to 5%, Cr: 7 to 15%, and Ni: 0 to 8%, wherein a wall thickness t (mm) and contents of C and Cr satisfy the relationship represented by the following equation (1)

$$t(\text{mm}) \leqq \exp\{5.21-18.1\text{C}(\%)-0.0407\text{Cr}(\%)\} \quad (1)$$

The manufacturing method of the invention comprises forming a steel pipe, which comprises, on the weight basis, C: 0.005 to 0.2%, Si: 1% or below, Mn: 0.1 to 5%, Cr: 7 to 15%, and Ni: 0 to 8% wherein a wall thickness, t (mm) and contents of C and Cr satisfy the relationship represented by the above-mentioned equation (1); quenching the steel pipe in water.

The inventors made a series of studies on the influences of chemical components and wall thickness, on the quench crack of martensitic stainless steel pipes, having a wall thickness of about 10 to 30 mm.

When a steel is quenched, the content of C is very important since it not only determines the hardness after quenching, but also greatly influences toughness. Accordingly, the relationship between the C content and the impact value in the Charpy impact test was investigated on a martensitic stainless steel having a content of 13% Cr.

The results of the test are shown in FIG. 1. From FIG. 1, it is found that when the C content exceeds 0.2%, the impact value decreases considerably. The quench crack is considered a result of the internal stress developed by the difference in the initiation time of transformation between the surface portion and the central portion of the pipe wall during a cooling step. It is also considered that if the toughness is unsatisfactory, the quench crack is likely to occur. Therefore, in order to prevent the quench crack, it is essential to decrease the C content so as to ensure satisfactory toughness.

Next using steel pipes, whose content of C was lower than 0.2%, and which had different chemical compositions and wall thicknesses, the quench crack caused by water quenching was investigated. As a result, it was found that the quench crack tended to occur in a manner as shown in FIG. 2. More particularly, the limit of a wall thickness at which no crack develops greatly depends on the C content, and the limit of the wall thickness decreases with increasing the C content. Moreover, the limit of the wall thickness at which any crack does not occur also changes depending on the Cr content, but its influence is not so significant.

When quenched in water, a martensitic stainless steel pipe undergoes martensitic transformation throughout the wall of the steel pipe, it can be easily assumed that a greater wall thickness tends to develop a greater internal stress. Moreover, even if the martensitic transformation proceeds to substantially 100%, a larger content of C brings about a greater internal stress because the larger the C content is, the higher a coefficient of volumetric expansion of the steel becomes. Furthermore, the reason why the crack could occur due to a higher content of Cr is considered that the toughness of the steel decreases as strength increases.

Thus, the inventors clarify the limitation of each of the elements of the steel and the relationship between the chemical composition and wall thickness of the steel pipe for preventing quench crack and also make it possible for a martensitic stainless steel pipe to apply water quenching, which has been thought not to be applicable for such a steel up to this invention.

DETAILED DESCRIPTION OF THE INVENTION

Reason for limiting chemical composition of the steel according to the present invention is described in detail hereafter, wherein percent signifies percent by weight.

Figure 1:
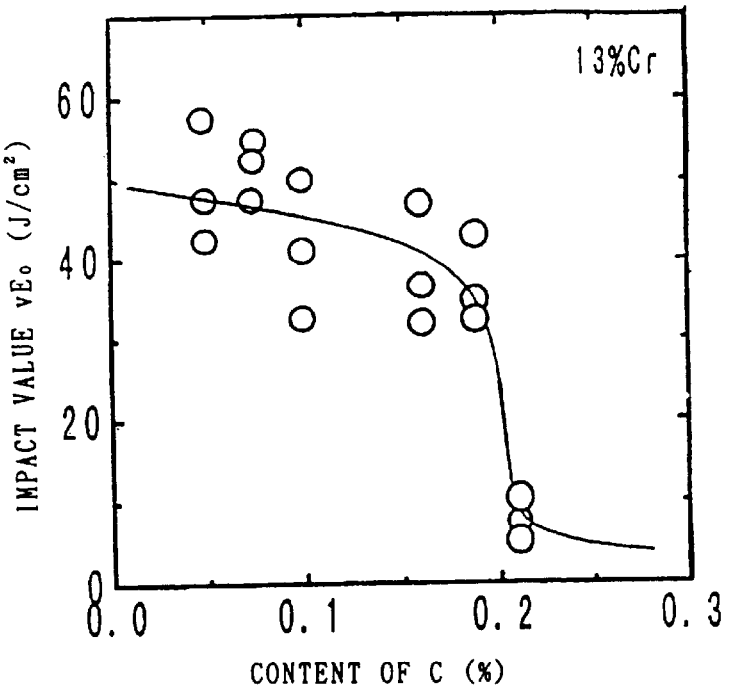
FIG. 1 is a graph showing the influence of the C content on the toughness (Charpy impact value (vEo)) of 13% Cr stainless steel after quenching.

The C content greatly influences strength and toughness after quenching. A larger content results in the increase of strength but the decrease of toughness as shown in FIG. 1. Too much content is not favorable from the standpoint of corrosion resistance. In view of these facts along with the occurrence of the quench crack, resulting from a decrease of toughness, the C content is defined at 0.2% or below. It should be noted that when the C content is extremely low, a desirable level of hardness cannot be obtained. Therefore, the C content must be 0.005% or over. Preferably, the C content is in the range of 0.01 to 0.15%.

Si is added as a deoxidant in the course of steel refining. The Si content is 1% or below, as regulated in ordinary stainless steel pipe.

Mn is an element for improving hot workability, and should be present in amounts of 0.1% or above, in order to achieve its effect of addition. However, if the Mn content increases, a austenite structure is retained after quenching, and toughness, and corrosion resistance deteriorate. Thus, the Mn content should be, at most, up to 5%. Where a pitting corrosion resistance is necessary, the Mn content should be less than 1%, preferably not larger than 0.5%.

Cr is an essential element for providing corrosion resistance to stainless steel. The Cr content is in the range of 7 to 15%. When the Cr content is 7% or over, a corrosion rate of the steel can be reduced to such an extent that no problem is practically involved under various environmental conditions. However, in order to form a corrosion resistance film inherent to a stainless steel, Cr should preferably be contained in amounts of 10% or over. If the Cr content is in excess, a 6 phase appears on heating at high temperatures at the time of quenching and, if a δ phase is left after quenching, it degrads the corrosion resistance. In addition, excessive Cr has the tendency that may cause quench crack, so that the upper limit of the Cr content is 15%.

N is an inevitable impurity. If the N content is more than 0.025%, the susceptibility of quench crack increase remarkably as well as C. However, if the N content is 0.025% or less, a water quench is applicable during a pipe making process to the steel satisfying the formula defined by the present invention without an influence of quench crack susceptibility . Therefore, N content should be 0.025% or less.

Ni may not be present. However, Ni is effective in not only improving corrosion resistance, but also improving strength and toughness. Accordingly, Ni may be present in the range of up to 8%, if necessary. In order to show the effects, it is preferred to contain Ni in amounts of 0.3% or over. However, if Ni is present in excess, a retained austenite structure is formed, thereby causing deterioration in both corrosion resistance and toughness. Therefore, Ni content should be up to 8%, preferably less than 4%.

For the purpose of improving hot workability at the time of manufacturing a steel pipe of the invention, at least one of Ca, Mg, La and Ce may be added to each within a range of 0.001 to 0.01%. By the addition of these elements, defects caused during the pipe manufacturing process and also quench crack, caused by water quenching are suppressed.

When used in co-existence, Cr, Mo and W serve to remarkably improve pitting corrosion resistance and sulfide stress corrosion resistance. If necessary, either or both of Mo and W may be added . If added, a good effect is obtained when the content of Mo+0.5 W is 0.2% or over. On the other hand, when the content of Mo+0.5 W exceeds 5%, a 6 phase appears, thereby not only lowering a corrosion resistance conversely, but also lowering hot workability.

Nb, Ti and Zr, respectively, have the effect of fixing C and reducing a variation of strength. If necessary, one or more of these elements may be added . If added, each content of these elements is in the range of 0.005 to 0.1%.

Other inevitable impurities such as P, S, O and the like deteriorate corrosion resistance and toughness, like the case of ordinary stainless steels, and their contents should preferably be made as small as possible.

In addition to meet the requirement for the chemical composition of the steel as mentioned above, the wall thickness t (mm) of the steel pipe should satisfy the following equation (1)

$$t(\text{mm}) \leqq \exp\{5.21-18.1\text{C}(\%)-0.0407\text{Cr}(\%)\} \quad (1)$$

Figure 2:
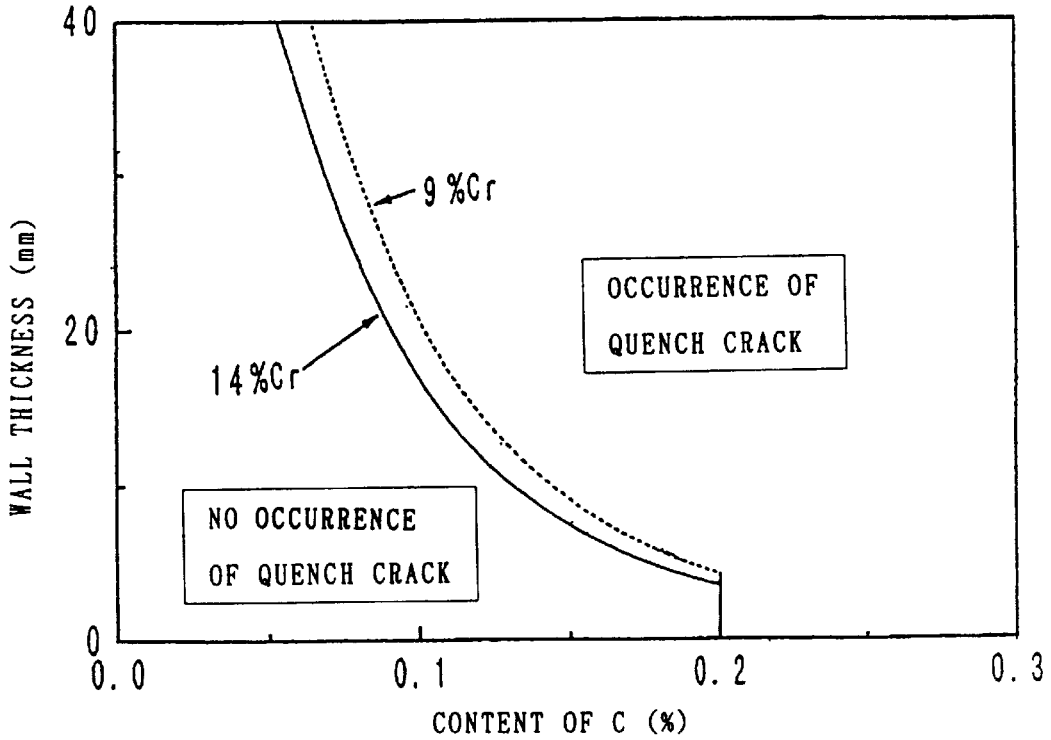
FIG. 2 is a graph showing the relationship between the C content and the thickness of a pipe wall for the occurrence of quench crack when 9% and 13% Cr stainless steel pipes are quenched in water.

This equation is one that is introduced on the basis of the results shown in FIG. 2, approximating a boundary line between the region wherein quench crack takes place and the region where no quench crack occurs by water quenching. When the wall thickness t (mm) of a steel pipe is within a range satisfying the above equation, no quench crack takes place by water quenching. When the wall thickness exceeds the range of the equation, a possibility of causing quench crack increases.

It will be noted that the water quenching in the manufacturing method of this invention includes not only a method wherein a steel pipe is immersed in water in a water vessel, but also a method wherein a large amount of water is poured on inner and outer surfaces of a steel pipe, thereby permitting the pipe to be substantially quenched in water.

After water quenching, a tempering treatment is normally carried out for a steel pipe to obtain optimum mechanical properties for a purpose of use.

EXAMPLES

Nine ingots of steel having chemical compositions indicated in Table 1 were made, followed by hot forging to form billets with a diameter of 200 mm. The billets were, respectively, shaped into pipes having an outer diameter of 120 mm, a wall thickness of 30 mm and a length of about 5 m according to a hot extrusion method. Each pipe was cut into 1 m long pieces, followed by machining to provide pipe pieces having different wall thicknesses ranging from 2.5 mm to 28 mm. These pipes were, respectively heated at 1000° C. for 30 minutes, followed by water quenching by immersion in a water vessel. After quenching, whether or not quench crack took place was visually observed.

At the time of quenching in water, a water stream was passed so that water was well circulated along the inner surfaces of the pipes. The cooling rate was determined so that the time required for the cooling of the steel pipe from 800 to 500° C. was measured at a center of the pipe wall by a thermocouple and converted to a unit of ° C./second.

After quenching, each pipe was tempered at 550° C. Then, a tensile test and a Sharpy impact test were carried out on specimens taken from each pipe to determined mechanical properties.

TABLE 1

| Steel | Chemical Composition (%) (balance: Fe and inevitable impurities) | | | | | | | |
|---|---|---|---|---|---|---|---|---|
| No. | C | Si | Mn | P | S | Ni | Cr | N |
| 1 | 0.19 | 0.21 | 0.72 | 0.001 | 0.0010 | 0.09 | 14.8 | 0.010 |
| 2 | 0.08 | 0.88 | 0.31 | 0.001 | 0.0010 | 2.83 | 11.3 | 0.008 |
| 3 | 0.01 | 0.79 | 3.25 | 0.001 | 0.0008 | 1.22 | 10.7 | 0.005 |
| 4 | 0.01 | 0.22 | 0.25 | 0.001 | 0.0008 | 1.36 | 7.45 | 0.021 |
| 5 | 0.18 | 0.19 | 0.22 | 0.001 | 0.0009 | 7.21 | 14.9 | 0.009 |
| 6 | 0.15 | 0.91 | 4.88 | 0.001 | 0.0010 | 0.33 | 13.2 | 0.008 |
| 7 | 0.25* | 0.88 | 0.32 | 0.001 | 0.0010 | 7.85 | 14.8 | 0.008 |
| 8 | 0.19 | 0.88 | 0.30 | 0.001 | 0.0010 | 7.85 | 15.9* | 0.031 |
| 9 | 0.19 | 0.22 | 5.41* | 0.001 | 0.0010 | 8.22* | 13.4 | 0.007 |

The mark "*" indicates a content outside the range defined in the invention.

Table 2 shows the results of an experiment for determining the relationship between the wall thickness of a steel pipe and the quench crack, and the mechanical properties of a steel pipe after quenching and tempering. As will be apparent from these results, in case of test Nos. 1 to 8, wherein the chemical composition and the wall thickness satisfy the ranges of the invention, no quench crack took place. However, in case of test No. 9 or 10, wherein a wall thickness is in the range defined in the equation (1), but a content of C or Cr exceeds the range defined in the present invention, quench crack took place. The case of test Nos. 11 to 14, wherein chemical compositions are respectively within a range defined in the present invention, but their wall thicknesses are outside the range defined in the equation (1), quench crack took place. In case of test No. 15, no quench crack occurred, but a retained austenite structure was recognized, so that the vTs (transition temperature) was high.

TABLE 2

| Test No. | Steel No. | Value of Equation (1)* | Wall Thickness of pipe (mm) | Average Cooling Rate On Hardening (° C./second) | Occurrence of Quench Crack | Yield Strength (kgf/mm$^2$) | vTs impact transition temperature (° C.) | Remarks |
|---|---|---|---|---|---|---|---|---|
| 1 | 1 | 3.22 | 3.0 | 300 or over | No | 81.8 | −5 | Inventive |
| 2 | 2 | 27.20 | 20.0 | 28 | No | 72.5 | −40 | Example |
| 3 | 3 | 98.40 | 20.0 | 28 | No | 68.2 | −45 | |
| 4 | 4 | 112.80 | 20.0 | 28 | No | 63.7 | −40 | |
| 5 | 5 | 3.84 | 3.5 | 300 | No | 79.1 | −20 | |
| 6 | 6 | 7.08 | 7.0 | 100 | No | 73.8 | −15 | |
| 7 | 1 | 3.22 | 2.0 | 300 or over | No | 81.8 | −5 | |
| 8 | 5 | 3.86 | 2.0 | 300 or over | No | 79.9 | −20 | |
| 9 | 7* | 1.08 | 1.0 | 300 or over | Yes | 88.4 | 10 | Comparative |
| 10 | 8* | 3.08 | 3.0 | 300 or over | Yes | 84.1 | −10 | Example |
| 11 | 1 | 3.22 | 3.5* | 300 or over | Yes | 80.7 | 0 | |
| 12 | 2 | 27.20 | 28.0* | 21 | Yes | 71.1 | −40 | |
| 13 | 5 | 3.84 | 4.0* | 150 | Yes | 78.2 | −20 | |
| 14 | 6 | 7.08 | 8.0* | 95 | Yes | 70.5 | −20 | |
| 15 | 9* | 3.41 | 3.0 | 300 or over | No | 84.5 | 0 | |

The mark "*" indicates the steels outside the range of the invention. ** Average cooling rate = (800° C.–500° C.)/(a time required for cooling from 800° C. to 500° C.), Equation (1) = exp{5.21 − 18.1 C (%) − 0.0407 Cr (%)}

According to the invention, martensitic stainless steel pipe, which has been conventionally subjected only to slow cooling or oil cooling in order to prevent quench crack, can be manufactured by water quenching. In this way, the cooling time in the quenching step can be shortened, bringing about not only a remarkable improvement in productivity, but also the effect of reducing facility cost.

What is claimed is:

1. A martensitic stainless steel pipe which comprises, on the weight basis, C: 0.005 to 0.2%, Si: 1% or below, Mn: 0.1 to 5%. Cr: 7 to 15%, N: 0.025% or below and Ni: 0 to 8%, wherein a wall thickness t (mm) and contents of C and Cr satisfy the relationship represented by the following equation (1)

$$t(\text{mm}) \leqq \exp\{5.21-18.1\text{C}(\%)-0.0407\text{Cr}(\%)\} \quad (1)$$

2. A martensitic stainless steel pipe according to claim 1, wherein the content of C, on the weight basis, is 0.01 to 0.15%.

3. A martensitic stainless steel pipe according to claim 1, wherein the content of Cr, on the weight basis, is 7 to 12%.

4. A martensitic stainless steel pipe according to claim 1, wherein the content of Mn, on the weight basis, is less than 1%.

5. A martensitic stainless steel pipe according to claim 2, wherein the content of Mn, on the weight basis, is less than 1%.

6. A martensitic stainless steel pipe according to claim 3, wherein the content of Mn, on the weight basis, is less than 1%.

7. A martensitic stainless steel pipe according to claim 1, wherein the content of Mn, on the weight basis, is not larger than 0.5%.

8. A martensitic stainless steel pipe according to claim 2, wherein the content of Mn, on the weight basis, is not larger than 0.5%.

9. A martensitic stainless steel pipe according to claim 3, wherein the content of Mn, on the weight basis, is not larger than 0.5%.

10. A method of manufacturing a stainless steel pipe which comprises forming a steel pipe which comprises, on the weight basis, C: 0.005 to 0.2%, Si: 1% or below, Mn: 0.1–5%, Cr: 7–15%, N: 0.025% or below and Ni: 0 to 8%, wherein a wall thickness t (mm) and contents of C and Cr satisfy the relationship represented by the following equation (1)

$$t(\text{mm}) \leqq \exp\{5.21-18.1\text{C}(\%)-0.00407\text{Cr}(\%)\} \quad (1); \text{ and}$$

quenching the steel pipe in water, wherein the steel pipe is at an elevated temperature during or after said forming step.

* * * * *